US007179236B2

(12) United States Patent
Galvez Campos

(10) Patent No.: US 7,179,236 B2
(45) Date of Patent: Feb. 20, 2007

(54) SYSTEM FOR EXERCISING THE LOWER EXTREMITIES IN SEATED PERSONS

(76) Inventor: José Luis Galvez Campos, Fray Luis Amigó, 4, 50006 Saragossa (ES)

( * ) Notice: Subject to any disclaimer, the term of this patent is extended or adjusted under 35 U.S.C. 154(b) by 233 days.

(21) Appl. No.: 10/433,927

(22) PCT Filed: Jun. 7, 2001

(86) PCT No.: PCT/ES01/00235

§ 371 (c)(1),
(2), (4) Date: Oct. 9, 2003

(87) PCT Pub. No.: WO02/45644

PCT Pub. Date: Jun. 13, 2002

(65) Prior Publication Data

US 2004/0053753 A1 Mar. 18, 2004

(30) Foreign Application Priority Data

Dec. 7, 2000 (ES) ..... 200002939
Jan. 26, 2001 (ES) ..... 200100182
Feb. 27, 2001 (ES) ..... 200100462

(51) Int. Cl.
*A61H 23/00* (2006.01)
*A63B 69/18* (2006.01)

(52) U.S. Cl. ..... 601/29; 601/35; 482/70; 482/71

(58) Field of Classification Search ..... 601/5, 601/23, 27, 31, 32, 29, 34, 35, 86, 87, 104, 601/24, 30, 36; 482/70, 52, 53, 51, 71
See application file for complete search history.

(56) References Cited

U.S. PATENT DOCUMENTS

| | | | |
|---|---|---|---|
| 2,255,066 | A | 9/1941 | Lamb |
| 2,924,214 | A | 2/1960 | Zak |
| 3,316,898 | A | 5/1967 | Brown |
| 3,370,584 | A | 2/1968 | Girten |
| 3,419,001 | A | 12/1968 | Woods |
| 3,774,597 | A | 11/1973 | Root |

(Continued)

FOREIGN PATENT DOCUMENTS

ES 2 029 714 10/1988

*Primary Examiner*—Danton DeMille
(74) *Attorney, Agent, or Firm*—Schiff Hardin LLP

(57) ABSTRACT

A system is provided for persons who must remain seated for extended periods of time, such as persons working in offices and the like. The system includes one or two support surfaces for the feet of the user, which are moved by a motor driven base. The support surfaces perform an alternating longitudinal movement, a lifting and lowering movement or a movement combining the two movements. The support surfaces are moved by, in one example, support rods hingedly connected to a central point of the support surfaces and at the other end to eccentric pivots allocated to respective toothed wheels which are mounted so at to rotate about their respective axis. An intermediate motor-driven pinion conveys rotational movement in the opposite direction to the wheels and are placed between the wheels. The support surfaces may be a bar that is transverse relative to the motor-driven base, which is preferably used in mass transit vehicles such as motor coaches, airplanes, etc.

4 Claims, 14 Drawing Sheets

U.S. PATENT DOCUMENTS

| | | | | |
|---|---|---|---|---|
| 3,917,261 | A | 11/1975 | Small et al. | |
| 4,185,622 | A | 1/1980 | Swenson | |
| 4,676,501 | A | 6/1987 | Hoagland et al. | |
| 4,842,265 | A | 6/1989 | Kirk | |
| 5,807,210 | A * | 9/1998 | Devlin | 482/52 |
| 6,780,142 | B1 * | 8/2004 | Takizawa et al. | 482/8 |

* cited by examiner

FIG. 1A
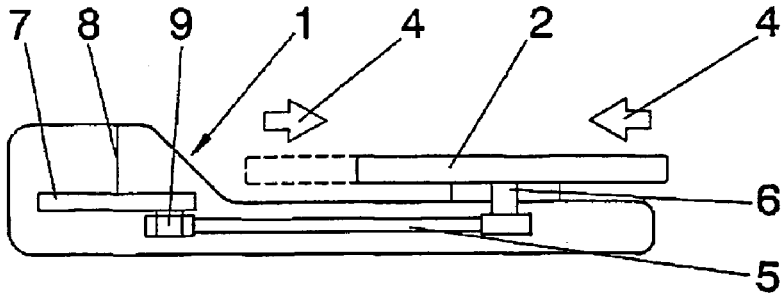
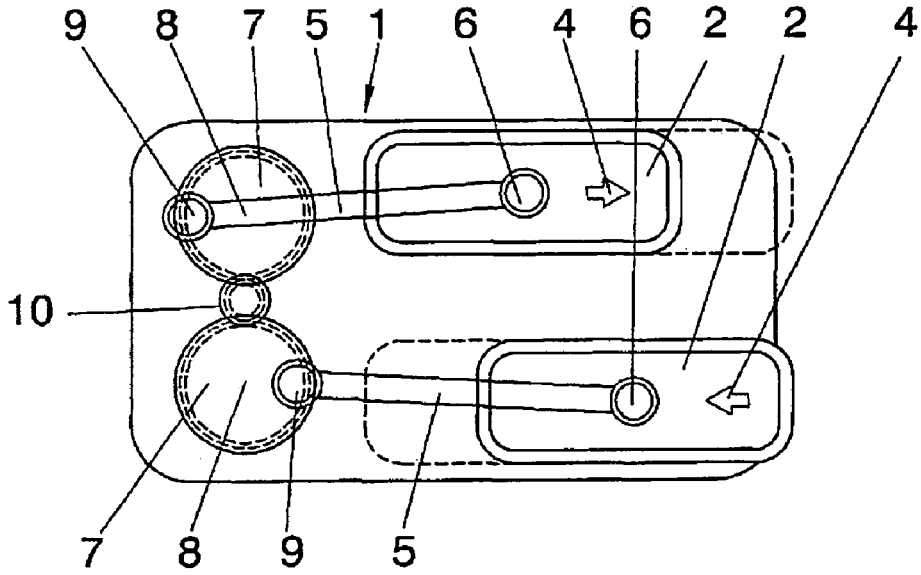
FIG. 1B

FIG. 2A
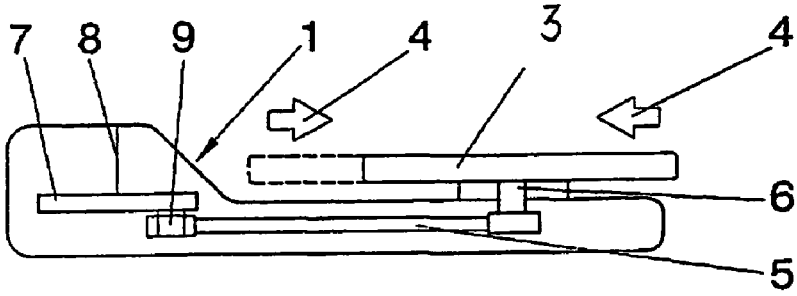
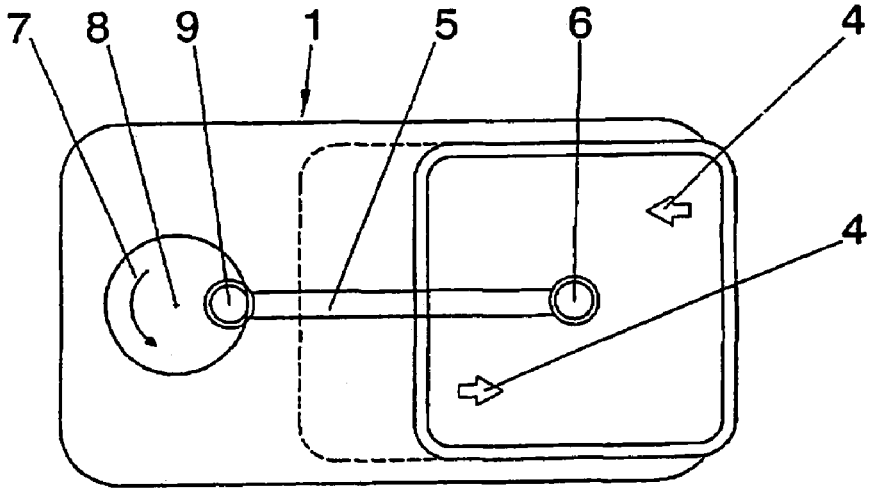
FIG. 2 B

FIG. 3A
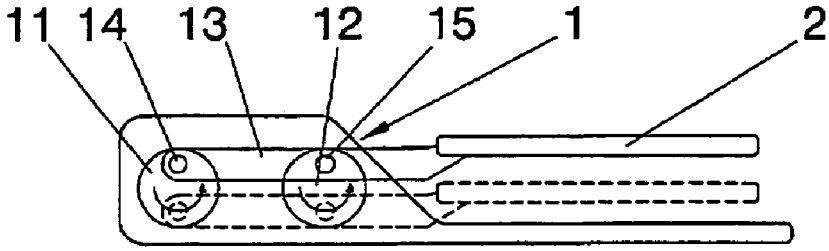
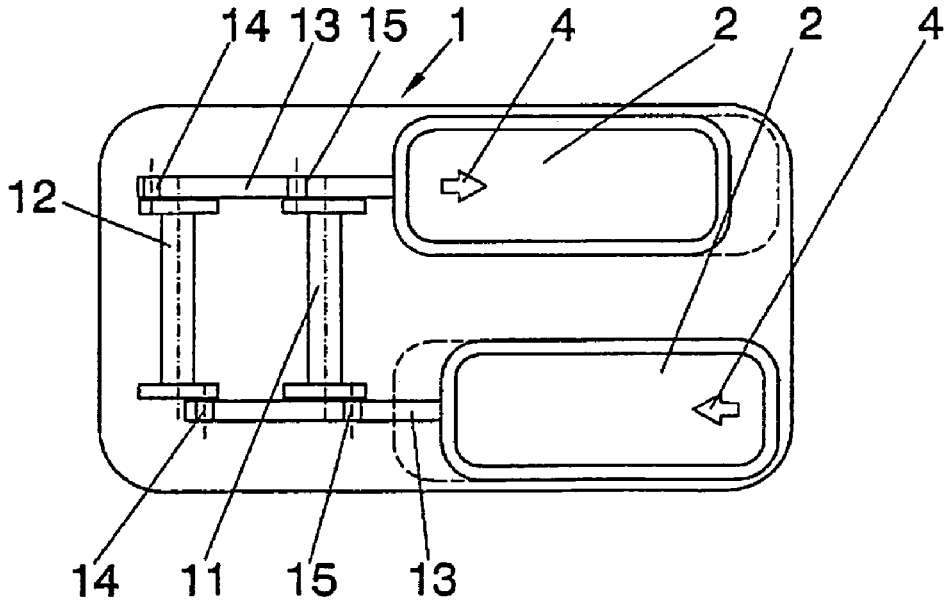
FIG. 3 B

FIG. 4A
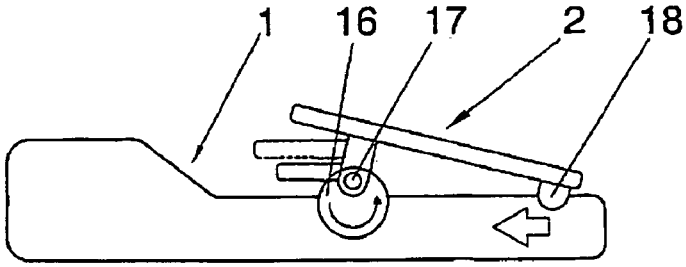
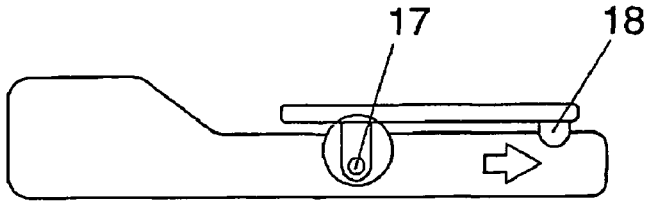
FIG. 4B
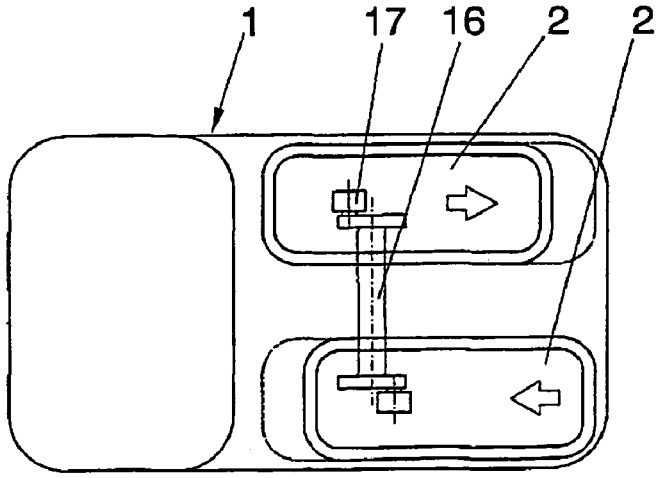
FIG. 4 C

FIG. 5A
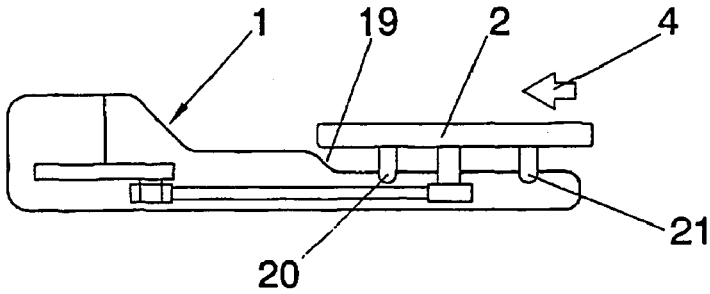
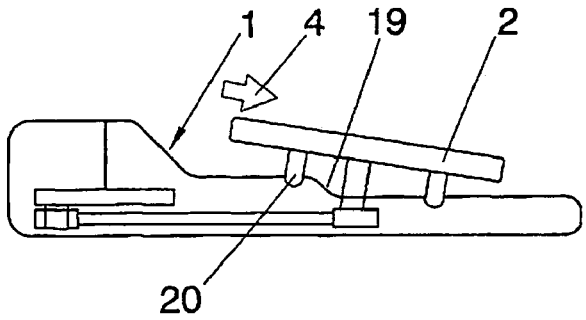
FIG. 5B
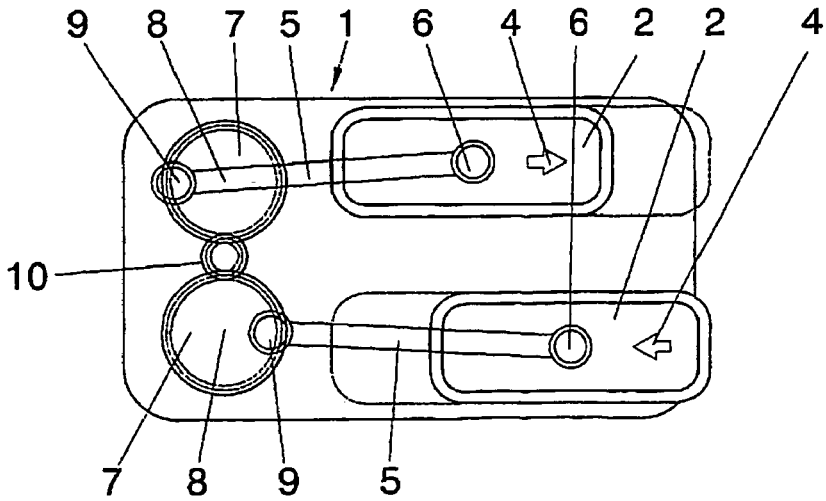
FIG. 5 C

FIG. 6A
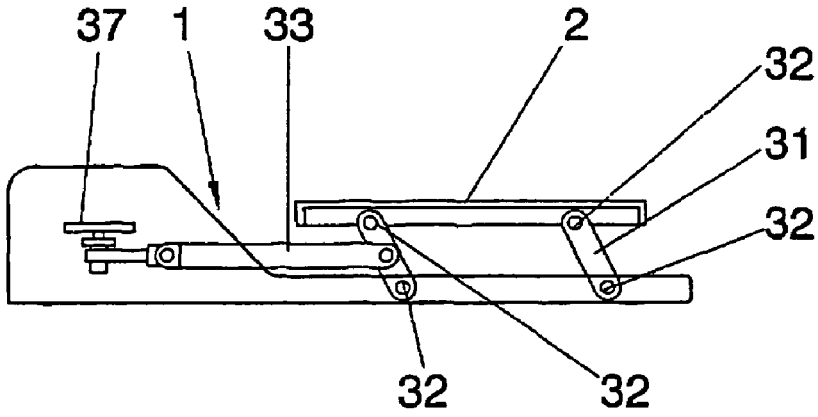
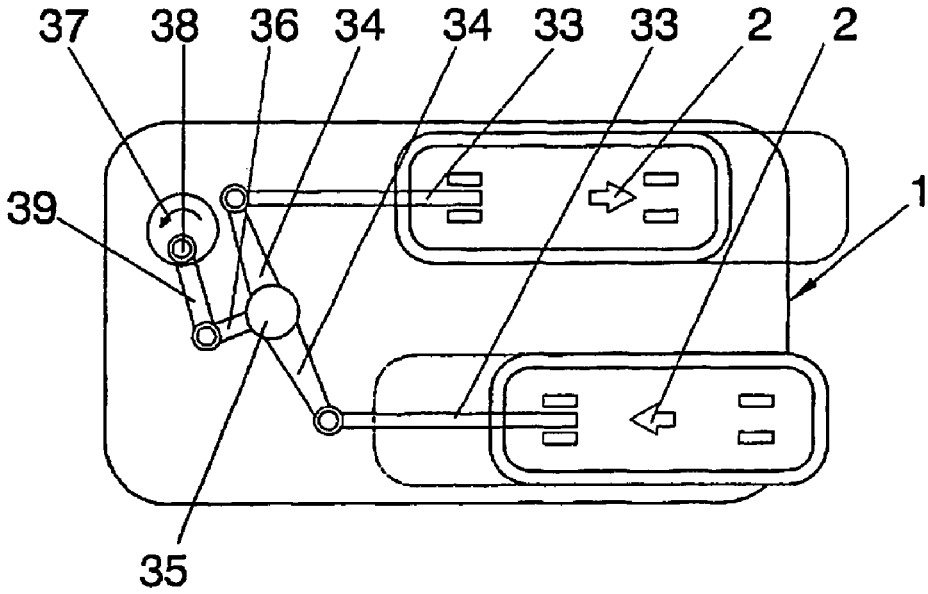
FIG. 6 B

FIG. 7A
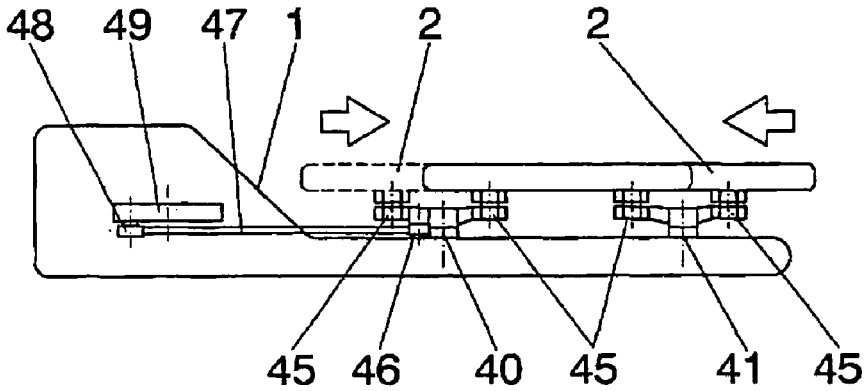
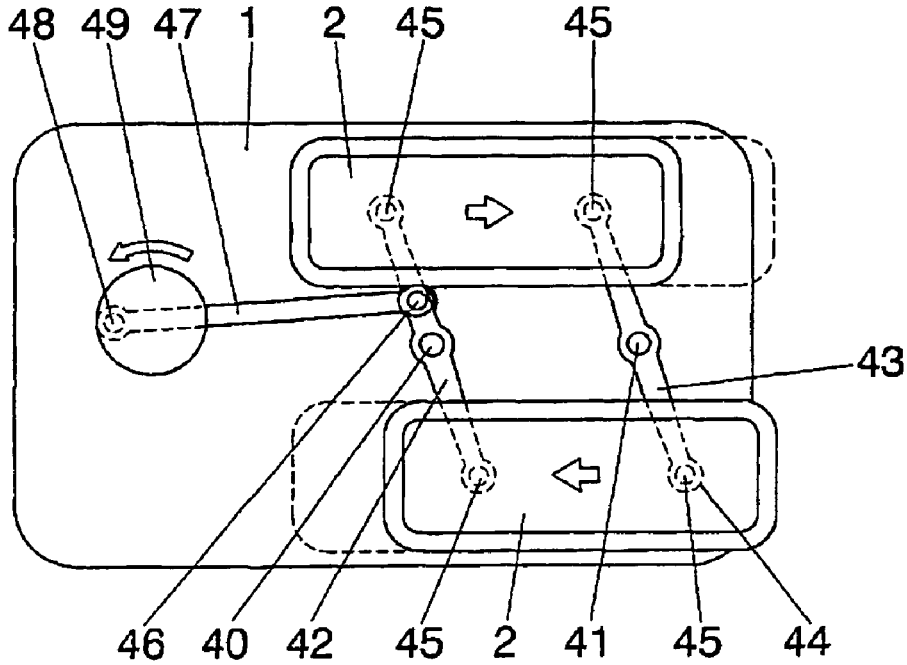
FIG. 7 B

FIG. 12A
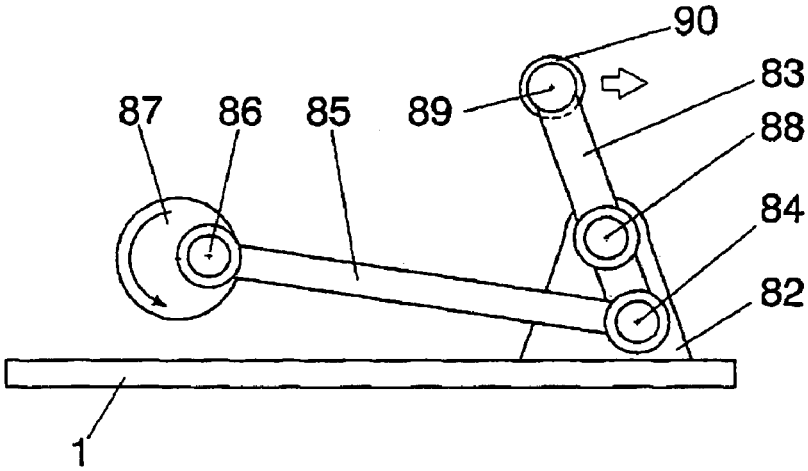
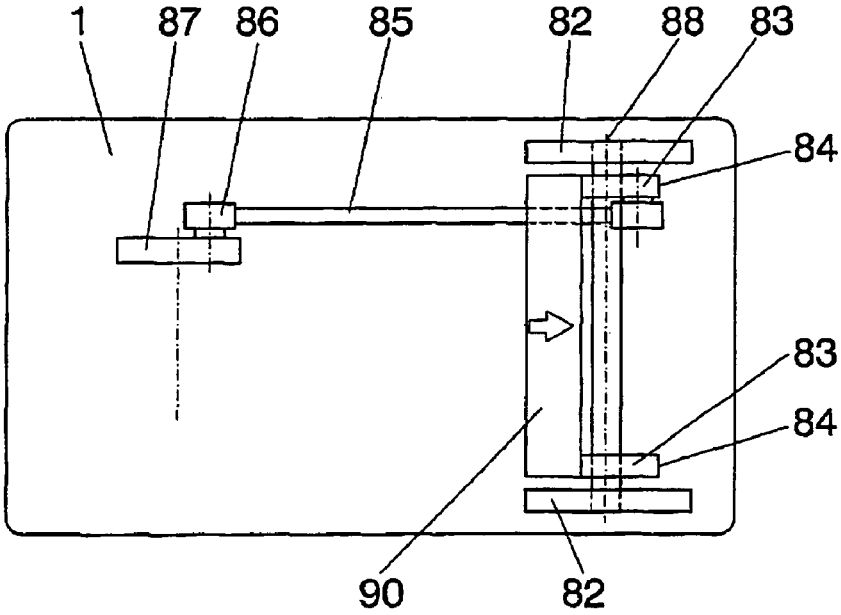
FIG. 12 B

FIG. 13A
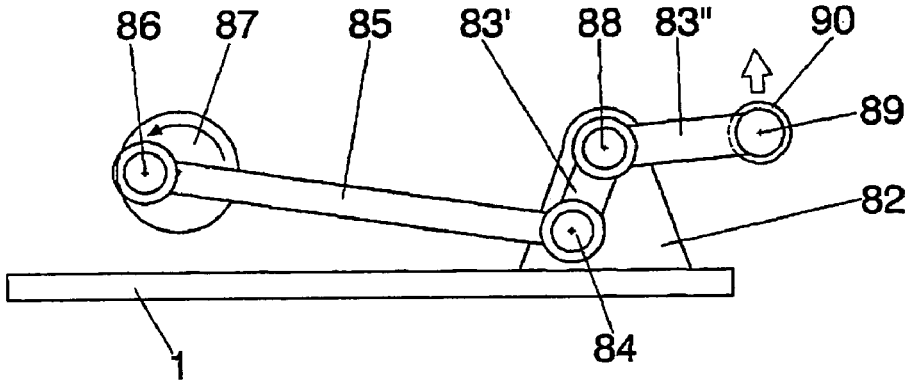
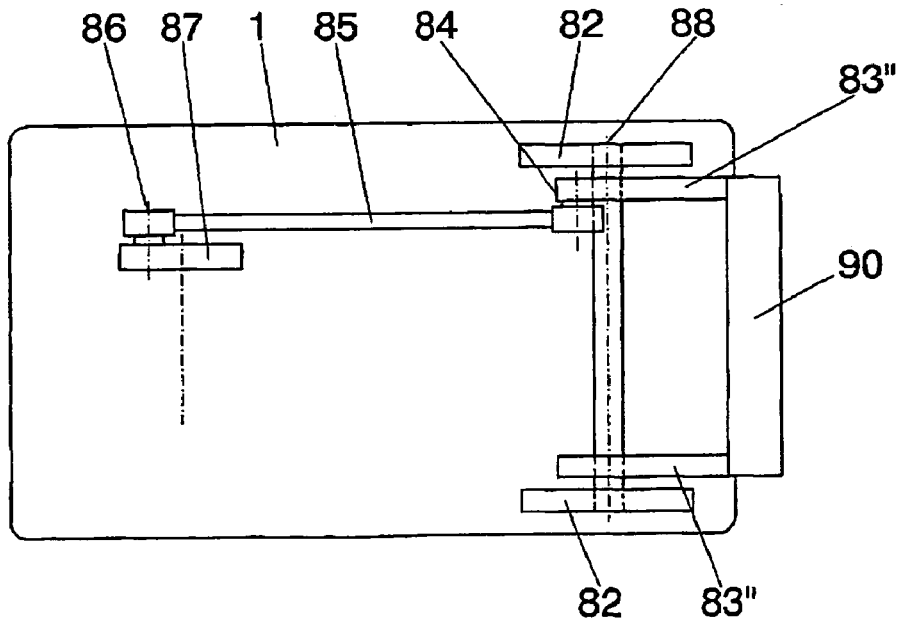
FIG. 13 B

FIG. 14A
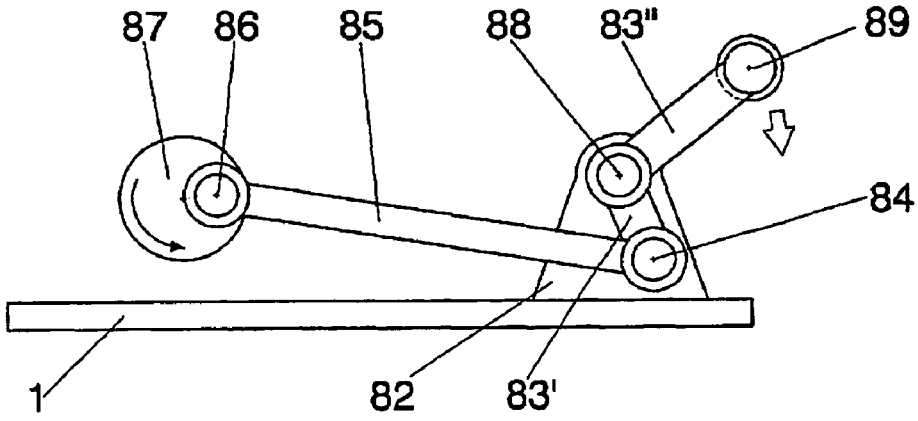
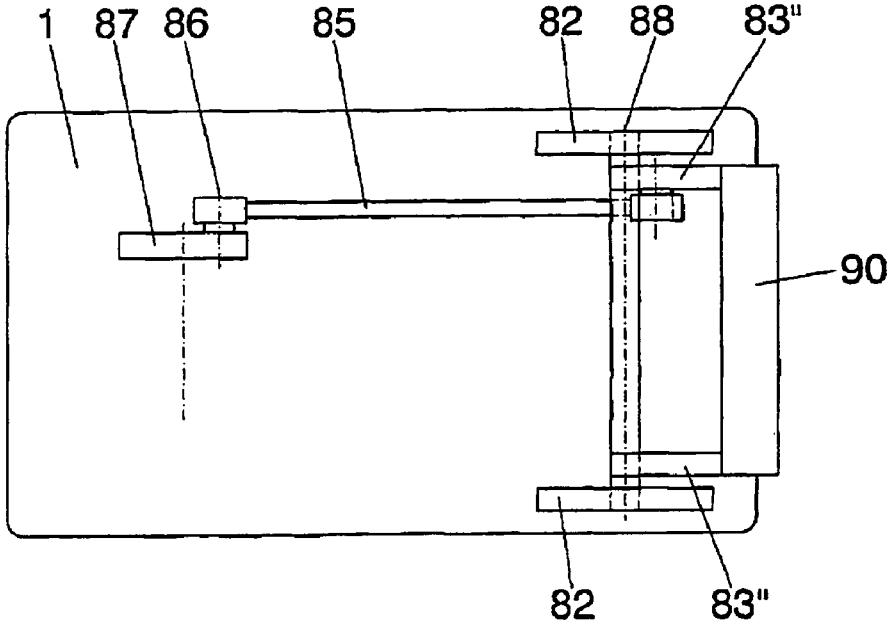
FIG. 14 B

SYSTEM FOR EXERCISING THE LOWER EXTREMITIES IN SEATED PERSONS

BACKGROUND OF THE INVENTION

1. Field of the Invention

The present invention relates generally to a system that has been specially designed so that a user who has to remain in the seated position on account of the nature of the user's work may exercise the user's lower extremities in the course of the working day with the resultant beneficial effect that this has on the user's general state of health and without impairing job performance.

2. Description of the Related Art

As is common knowledge, physical exercise is absolutely fundamental for maintaining a good state of health. Although certain working activities entail the necessary practice of physical exercise, there are however an increasing number of people who have to remain seated behind a computer, an office desk, etc. during practically the whole working day, performing wholly intellectual tasks with practically no physical exercise, especially at lower limb level.

This physical inactivity has a negative impact on health in the course of time creating situations of discomfort, fatigue, leg pains, etc.

The obvious solution to this problem is to carry out physical exercises outside working hours and in this respect there are people who devote a certain time every day to walking or performing different types of physical exercises, but obviously such person make up a minority group, as the vast majority do not have the time or means to perform such exercises.

There are numerous kinds of gymnastic apparatus, but none of them allows a person to carry out a certain physical exercise while working.

SUMMARY OF THE INVENTION

The system proposed by the invention provides a fully satisfactory solution to the afore-mentioned problem inasmuch as it permits the lower limbs to be exercised on the job during working hours. As pointed out above, the system does not interfere with the normal performance of the job to be done insofar as it is designed for persons who remain seated, i.e. for people whose legs are not involved in the work being done and which may therefore be mobilized, within certain limits, without affecting body stability and, therefore, without affecting the individual work rate.

For this purpose and more specifically the system consists of a motor-driven base for positioning under the desk, a motor-driven base which moves at least one support surface for the user's feet, which are thus subjected to a mobilization that extends to the whole of the lower extremities.

This mobilization may be simultaneous for both feet, i.e. they move together, specifically when they are resting on a single support surface, or their movements may be independent, alternating for instance, when two support surface, one for each foot, play a part in the system.

At the same time, the movement may also be of different types, specifically a longitudinal sliding movement of the feet, a lifting movement, a rocking movement or a mixed movement resulting from the combination of the foregoing.

In any case, the motor-driven base will conveniently support the bearing surfaces with freedom of movement for these and the driving element of the base will be connected to the support surface or surfaces by conventional type driving means which enable the desired movement to be performed.

In the various embodiments it is possible to achieve new movements or movement which may already be known by new means.

More specifically, one of the new possibilities envisaged consists of establishing on the motor-driven base a pair of longitudinally aligned vertical axles on each of which transverse and parallel rocking arms are mounted, which in turn are linked hingedly to the underside of the support surfaces, forming with these a deformable quadrilateral, while linked hingedly to one of these arms there is a connecting rod that links this quadrilateral to the motor-driven wheel eccentric to operate the assembly, thereby achieving an alternating longitudinal movement of the aforesaid support surfaces or, in other words, of the user's feet.

Another alternative provides a lifting and lowering movement for the feet, accompanied by a lateral rocking movement of same, in which case the support surfaces are fixed to a transverse support integral with a longitudinal axle mounted with freedom of movement, by way of a pair of bearings, on the motor-driven base, the aforesaid axle, by way of an eccentric piece, a connecting rod and another eccentric mounted on the driving wheel, an alternating rotational movement which is translated into a lateral rocking movement for the assembly made up of the two support surfaces, which may optionally be embodied in just one.

If the aim is for the movement of the bearing surfaces to be alternating and vertical only, i.e. without lateral rocking for such surfaces, a similar solution to that just described here may be used, with the exception that instead of using a rigid transverse connection support between the two bearing surfaces, two parallel arms should be used, hinged at their mid-point, one to the drive shaft and the other to a mere support shaft and linked in turn hingedly at their ends to lower vertical arms of the bearing surfaces, the latter forming a deformable parallelogram which permits the raising and lowering of the bearing surfaces without their losing, in turn, their horizontality.

Lastly, the bearing surface or surfaces may be provided solely with a longitudinal rocking movement, i.e. a raising and lowering movement of the area corresponding to the anterior extremity of the feet, in which case the bearing surface will be provided with a traverse shaft, offset to the rear, mounted with rotational freedom on the motor-driven base and integral with which there is a descending intermediate connecting rod, linked hingedly at its free end to another longitudinal connecting rod linked to the driving wheel eccentric.

In the event of the system being applied on collective transport vehicles, instead of there being a single support platform for the feet or else separate platforms, the supports are composed of a single transverse bar, which is driven back and forth or else rocked, or in other words, is raised and lowered with a rocking movement.

More specifically, in this alternative embodiment or application the principle of the system is that two separate parallel supports are mounted on the motor-driven base, preferably matching end parts of the base, and between the supports of which a traverse rotational shaft is mounted so that on this rotational shaft two side arms are mounted in turn, provided on the inside with supports, one of which is linked to a connecting rod, which is hinged eccentrically at its other end to a drive wheel, so that the alternating movement of this connecting rod entails the alternating movement of the arm to which the former is associated and thereby the rotation of the shaft between the base supports, at the same time bringing about the movement of the other arm, so that between both arms a bar is mounted which will form the support element for the feet, the bar being supplemented with an encasing tube turning freely on them, so that when rocking back or forth takes place it causes the casing to turn and thereby provides permanent support for the user's feet without varying their position, i.e. moving back and forth in unison with their support on the bar.

In another embodiment version, besides turning back and forth, the arms may carry out an upward and downward rocking movement as these arms are made up of two parts both connected to the transverse rotational shaft mounted between the supports.

In the former case of the two solutions just referred to, the bar ad therefore the feet resting on it undergo a back and forth movement with a slight arching in that forward and backward longitudinal movement, while in the latter case the bar undergoes a raising and lowering movement, or in other words, rocking up and down, naturally in a slightly arched movement as in the previous case.

BRIEF DESCRIPTION OF THE DRAWINGS

To supplement the description being given and in order to assist a clearer appreciation of the features of the invention, in accordance with a preferential specimen of practical embodiment of same, a set of drawings is attached wherein, for illustrative and not restrictive purposes, the following is represented:

FIGS. 1A and 1B show a side elevational view and top plan view of a first practical embodiment of the system for exercising the lower extremities at static work stations which represents the object of the present invention, in which tow support surfaces take part and where the movement of the surfaces is longitudinal and alternating.

FIGS. 2A and 2B show a side elevational view and a top plan view, according to a representation similar to that of FIGS. 1A and 1B, an alternative embodiment version in which a single bearing surface participates, provided also with an alternating longitudinal movement.

FIGS. 3A and 3B show a side elevational view and a top plan view of an embodiment version, according to a representation similar to that of the previous figures, in which two bearing surfaces participate, which in this case are subjected both to a longitudinal movement and to a raising and lowering movement.

FIGS. 4A, 4B and 4C show two side elevational views and a top plan view of another embodiment version in which two bearing surfaces also participate, but in this case affected by a combined longitudinal and rocking movement.

FIGS. 5A, 5B and 5C show two side elevational views and a top plan view of a representation similar to that of FIGS. 4A, 4B and 4C but corresponding to another way of obtaining movements similar to those of the last case.

FIGS. 6A and 6B show a side elevational view and a top plan view of a representation similar to that of FIGS. 3A and 3B but corresponding to another way of obtaining movements similar to those of the aforesaid FIGS. 3A and 3B.

FIGS. 7A and 7B shows a side elevational view and a top plan view of an alternative embodiment of the system.

FIGS. 12A and 12B shows the same side elevational and plan views as the embodiment represented in the previous figure, indicating the direction of backward movement of the foot support bar.

FIGS. 13A, 13B, 14A and 14B show respective pairs of elevational and lateral views, respectively, of another alternative embodiment in which instead of moving forward and backward the foot support bar rocks in an ascending and descending direction.

DETAILED DESCRIPTION OF THE PREFERRED EMBODIMENTS

Figure 8A:
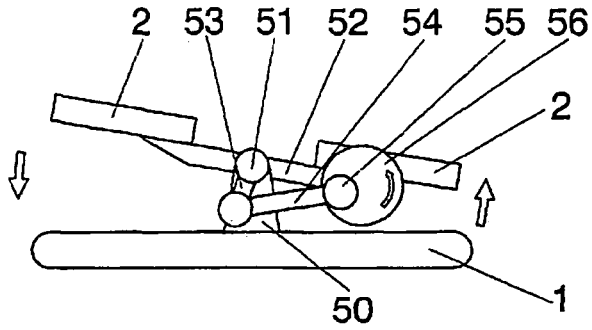
FIGS. 8A, 8B and 8C show two side elevational views and a top plan view of another alternative embodiment of the system.

If we refer in the first place to FIGS. 1A and 1B, we see that the practical embodiment of the system for exercising the lower limbs advocated here consists of a housing or motor-driven base 1, on which are mounted, with the option of longitudinal sliding, a pair of support surfaces 2, suitable in shape and size to take the user's feet, moving longitudinally and in opposing directions in accordance with the arrows referenced with 4, for which purpose and by way of the respective connecting rods 5, linked hingedly at 6 to the mid-point of the support surfaces 2 are connected by respective toothed wheels 7, mounted with rotational freedom by way of their shafts 8 on the actual base or housing 1, toothed wheels 7 to which the connecting rods 5 are linked by way of an eccentric pivot 9, the two toothed wheels 7 corresponding to the two support surfaces 2 being furthermore joined together by means of an intermediate pinion 10, which is what receives the movement of the corresponding motor, not represented in the drawing and which supplies rotational movements to the wheels 7 in the opposite direction in order to achieve alternating movements at the support surfaces 2 of an extent close to the diameter of the wheels 7 and in opposite directions.

The layout described is basically repeated in the practical embodiment represented in FIGS. 2A and 2B, in which there is a single support surface 3 for both feet, with the evident difference that in this case there will be a single connecting rod 5 and a single wheel 7 as well, which in this case will not be toothed and which will receive the movement directly from the motor by way of its own shaft 8.

In FIGS. 3A and 3B another embodiment version is represented in which two support surfaces 2 participate, as in the case of FIGS. 1A and 1B, although in this case the support bases 2 linked to respective supports 13 which are moved by a pair of transverse drive axles 11 and 12, provided at their wheel ends with eccentric pivots 14 and 15, whereby, in addition to the same longitudinal movement as in the case of FIGS. 1A and 1B, a vertical movement is achieved between the end situation shown with a continuous and dotted line in the lateral view in this FIGS. 3A and 3B.

With the participation also of two support surfaces 2, the embodiment of FIGS. 4A, 4B and 4C envisage the existence of a single motor-drive transverse shaft 16 terminated at each end with a wheel provided with respective opposing lugs 17, by way of which movement is transmitted to the support surfaces 2 relatively close to one of their ends, while their other end rests on the actual motor-driven base 1 by way of sliding supports 18, so that an upward/downward rocking movement of one of the ends of each support surface 2 is achieved, while the other end is kept at a constant height level, in parallel to a horizontal movement of the support surface.

In the embodiment in FIGS. 5A, 5B and 5C similar movements are achieved to those obtained in FIGS. 4A, 4B and 4C, but more extensive in the horizontal or longitudinal movement of the support surfaces 2, for which purpose the structure of the embodiment in FIGS. 1A and 1B is repeated, as regards the existence of the hinged pivots 6, the toothed wheels 7 and the drive pinion 10, but with the exception that in this case the swivel pivots 6 can rock sideways, for example by means of a cardan drive or 90°-hinged rocker arm, where the base or housing 1 has a ramp 19 and each support surface 2 has a pair of longitudinally spaced lower lugs 20 and 21, the pivot being designed to coincide with the ramp 19 in order to make the support surface 2 rock, as represented in the two side elevational views in the afore-mentioned FIGS. 5A, 5B and 5C.

In the embodiment shown in FIGS. 6A and 6B, in which also two support surfaces 2 participate, each of the support surfaces 2 is connected to the housing or base 1 by means of two pairs of connecting rods 31, hinged at their ends 32 both to the support surface 2 and to the housing 1, as may be seen especially in the side view, there being linked to the mid-point of the foregoing connecting rods 31 and also hingedly a drive rod 33, which is linked hingedly to a cross-arm 34, rocking on the housing 1 at its mid point 35 and extended in a short arm 36 by which both drive rods 33 receive an opposing alternating movement from a drive wheel 37 provided with an eccentric pivot 38 for transmitting movement to a short rod 39 linked to the arm 36. In this case the drive system described supplies a rocking movement to the connecting rods 31, equivalent to a longitudinal and horizontal movement of the support surfaces 2, which is combined with a raising and lowering movement, also generated by the actual rocking of the connecting rods 31.

In an embodiment version shown in FIGS. 7A and 7B, on the motor-driven base 1, in respect of which the support surfaces 2 have to be mobile, a pair of vertical shafts 40–41 are established, aligned longitudinally and centrally, on each of which an arm 42–43 is mounted, these arms 42–43 being parallel and identical and joined hingedly at their free end 44 to respective pivots 45 integral with the under side of the support surfaces 2, forming with the latter a deformable quadrilateral in which the rocking of these arms 42–43 causes a longitudinal movement of the surfaces 2 in the same plane, as may be seen in any of the figures and in accordance with the arrows represented in them.

This rocking movement of the arms 42–43 is carried out specifically on the arm 42 to which a connecting rod 47, which links the arm 42 to the drive wheel 49 eccentric 48, is attached hingedly by way of a swivel pivot offset in relation to the shaft 40.

Figure 8B:
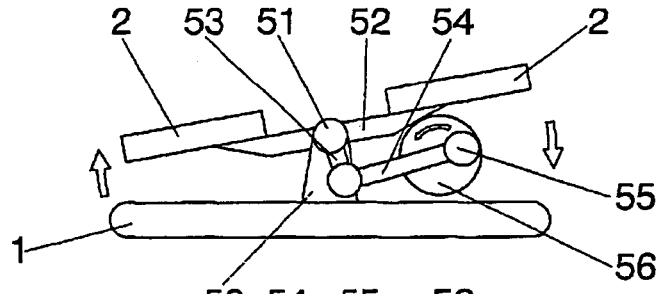
Figure 8C:
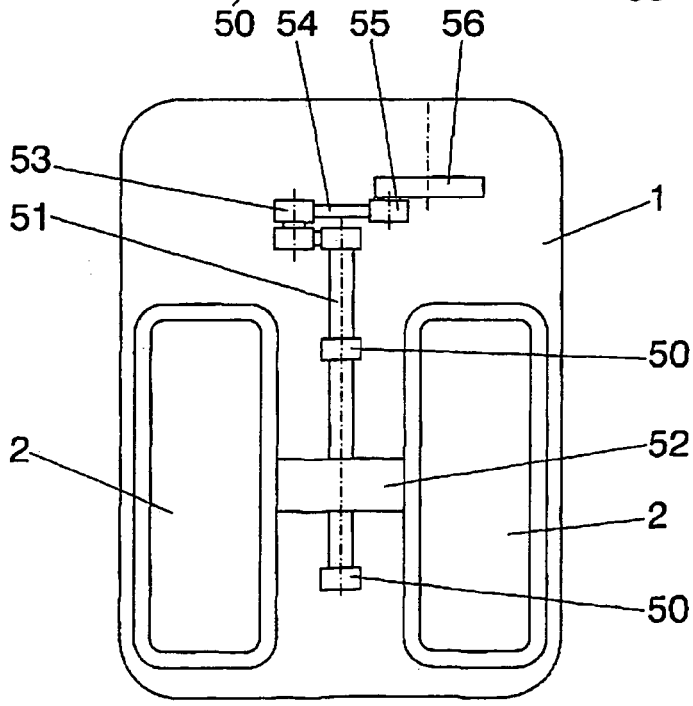

Moving on now to the practical embodiment of FIGS. 8A, 8B and 8C, in it and on the motor-driven base there are established a pair of supports 50 which, for instance with the aid of bearings, form supports for a longitudinal shaft 51 with which a transverse support 52 is integral, being integral in turn with the support surfaces 2, so that an angular rocking movement of the shaft 51 causes a lateral rocking movement with parallel raising and lowering of the support surfaces 2, which are shown by the two side elevational views of the aforesaid FIGS. 8A, 8B and 8C.

In order to achieve this rocking, the shaft 51 is terminated at one of its ends with a small radial extension 53 to which is attached hingedly the arm 54 which connects the shaft 51 to the drive wheel 56 eccentric 55, so that the rotational movement of the wheel 56 becomes an angular rocking movement of the shaft 51, which in turn is converted into the aforesaid rocking movement for the support surfaces 2.

Figure 9A:
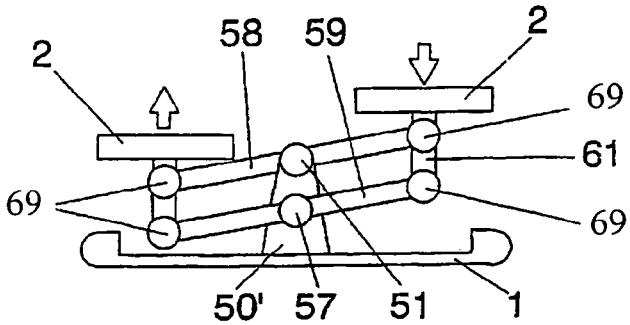
FIGS. 9A, 9B, 9C, 10A, 10B and 10C in turn show two side elevational views and a top plan view similar to that of FIGS. 8A, 8B and 8C, referring to respective versions of practical embodiments of the system.
Figure 9B:
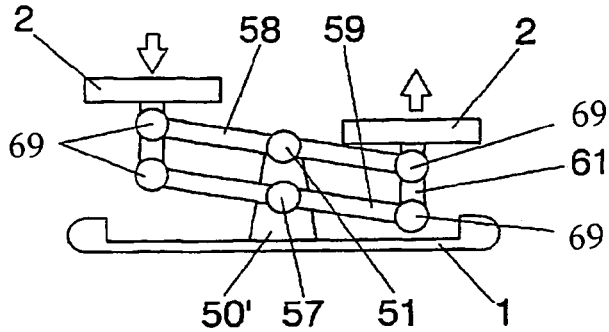
Figure 9C:
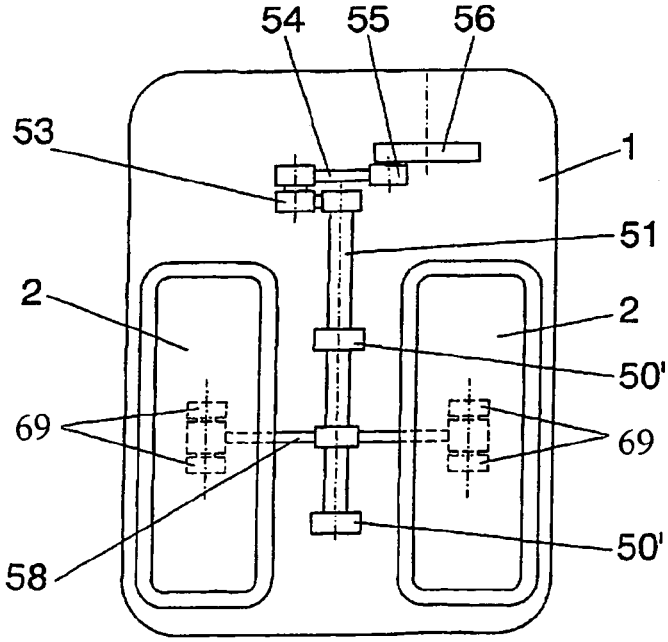

Going on now to analyze the practical embodiment shown in FIGS. 9A, 9B and 9C, relatively similar to that of the previous figures, in it with the shaft 51 that receives the movement of the drive wheel 56 there collaborates a second shaft 57, parallel and below the shaft 51, mounted like the former on supports 50', somewhat higher than those in the previous case, so that with these shafts 51 and 57 there are associated respective transverse and parallel arms 58 and 59, which are connected hingedly at their ends 69 to vertical arms integral with the under side of the support surface 2, the arms 58, 59 and 61 forming a deformable parallelogram which keeps the arms 61 vertical all the time, permitting their vertical movement, as shown in the two side elevational views in the above-mentioned FIGS. 9A, 9B and 9C, i.e. a vertical alternating movement of the a support surfaces 2 is achieved with the action of the drive wheel 56, in which these are kept horizontal all the time.

Figure 10A:
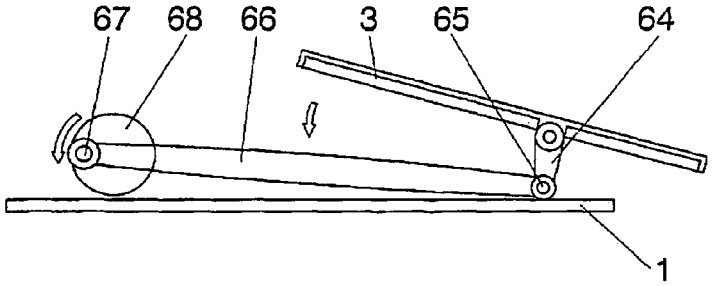
Figure 10B:
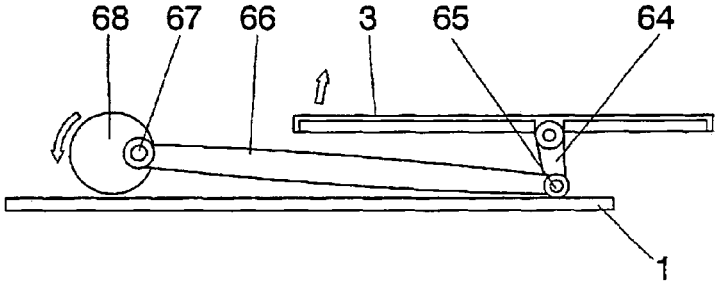
Figure 10C:
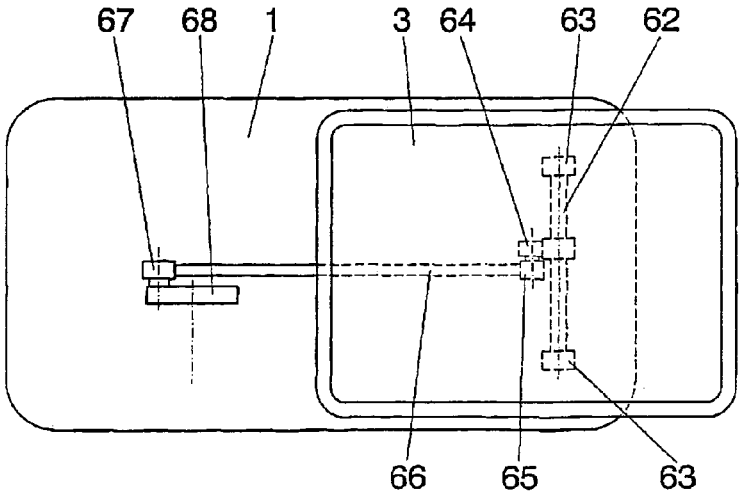

In the embodiment in FIGS. 10A, 10B and 10C, a single support surface 3 is established on the motor-driven base, although obviously there could be two surfaces, specifically the surface being provided with a transverse eccentric shaft 62, mounted on end supports 63, the shaft 62 with which there is integral a lower radial arm 64, which is attached hingedly at its free end 65 to a longitudinal connecting rod 66, which is attached hingedly at its other end to the drive wheel 68 eccentric 67, so that in this case the rotational movement of the drive wheel 68 is converted into a rocking movement of the arm or extension 64 of the support surface 3 and consequently into a longitudinal rocking movement of the former, between the limit situations shown in the two lateral views of the afore-mentioned FIGS. 10A, 10B and 10C.

Figure 11A:
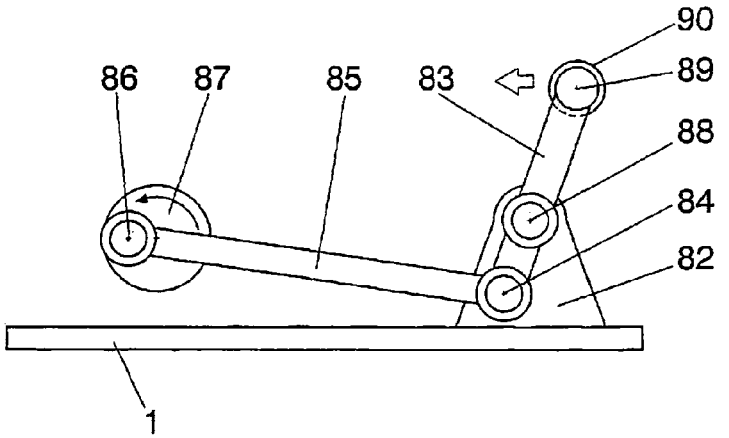
FIGS. 11A and 11B shows a side elevational view and a top plan view of a practical alternative embodiment of the lower extremity exercising system, applicable primarily to transport vehicles, without ruling out its use or application anywhere else. In these figures we may see the direction of longitudinal forward movement of the bar forming the support for the feet.
Figure 11B:
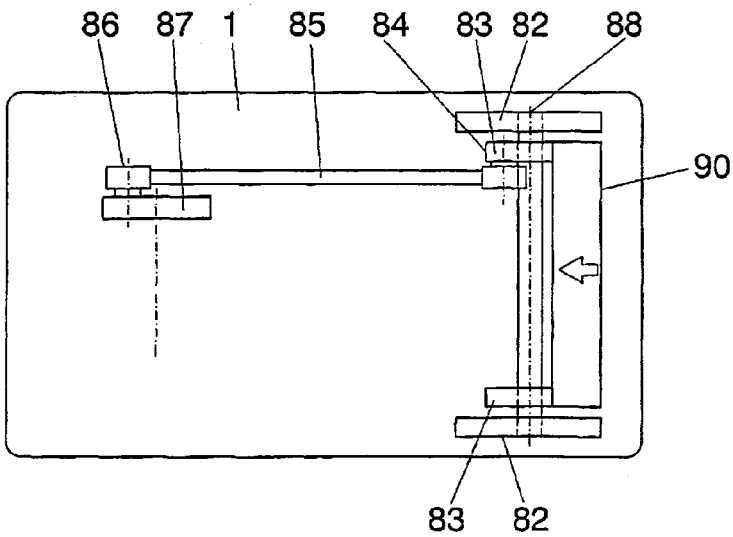

In FIGS. 11A and 11B it may be seen that on the motor-driven base 1 in relation to which the support surfaces, composed in this case of a transverse bar 89 and a tubular casing 90, which turns freely in respect of the bar 89, have to be mobile, two supports 82 are established, arranged parallel to each other and adjacent to the sides of the aforesaid base 1 and matching up with one of the ends of same, between which supports 82 are mounted two arms 83, one which is attached by way of one end 4 with a connecting rod 85, which is hinged at the other end by means of an eccentric 86 on a rotating wheel 87, as a driving element which is naturally operated by a motor not shown. The arms 83 are mounted on a rotating shaft 88 established between the side supports 82, so that the bar 89 with its casing 90 is located between the opposite end of those arms 83.

In this way, the rotational movement of the wheel 87 produces the rotational and sliding movement of the connecting rod 85, transmitting the movement to the arms 83 and thereby to the shaft 88, causing the bar 89 mounted between the arms 83 to effect and back and forth movement, as shown by the arrows represented in the side elevational view in FIGS. 11A, 11B, 12A and 12B. This continuous to and fro movement by the bar 89 and therefore by the feet resting on it, will describe a small arc, which will be formed by the turning of the arms 83 on the shaft 88.

FIGS. 13A, 13B, 14A and 14B show an alternative embodiment so that, instead of being longitudinal to and fro, the movement is rocking up and down, so that in this case the components are the same, with the only exception that the arms are determined by the two sections 83' and 83" in order to make the sections 83" rock up and down as shown in the side elevational views in FIGS. 13A, 13B, 14A and 14B.

Both the movements described and the means for obtaining them are merely informative and any other kind of conventional drive transmission means may be used without this affecting the essence of the invention in any way at all.

The invention is primarily applicable in the sphere of office jobs and the like, where an operator has to remain seated during the larger part of the working day, although it may also be used in rehabilitation tasks and in any other circumstances in which similar performance is required, as is the case of collective transport vehicles on long journeys during which passengers are immobilized because of the shortage of space available.

Although other modifications and changes may be suggested by those skilled in the art, it is the intention of the inventors to embody within the patent warranted hereon all changes and modifications as reasonably and properly come within the scope of their contribution to the art.

The invention claimed is:

1. A system for exercising lower extremities of a seated person, comprising:

a motorized base;

a pair of transverse axles connected to be driven by said motorized base;

wheels coupled to said pair of transverse axles for rotation;

parallel supports mounted to said wheels by two pivots;

at least one support surface on said parallel supports on which feet of a user are rested to provide movements of the user's feet, said movements being at least one of vertical movement and horizontal movement and rocking movement.

2. A system for exercising lower extremities of a seated person, comprising:

a motorized base;

an intermediate common pinion connected to be driven by said motorized base;

toothed wheels coupled to said intermediate common pinion and mounted for rotation about respective centers;

connecting rods each having one end hingedly connected to an eccentric of a respective one of said toothed wheels, an opposite end of each of said connecting rods having a pivot;

support surfaces each connected to a respective one of said connecting rods at said pivots, said pivots providing for movement to the user's feet, said movement being at least one of vertical movement and horizontal movement and rocking movement.

3. A system for exercising lower extremities of a seated person, comprising:

a motorized base having a housing;

a wheel mounted to be driven by said motorized base;

an eccentric pivot mounted on said wheel;

a connecting rod connected to said eccentric pivot;

a radial arm connected to said connecting rod;

a crosspiece having a middle point connected to said radial arm, said crosspiece being pivotally mounted to said housing;

two connecting rods hingedly connected to said crosspiece;

a first pair of linking bars connected to respective ones of said two connecting rods and a second pair of linking bars, said first and second pairs of linking bars being hingedly connected to said housing; and support surfaces having said pairs of linking bars hingedly mounted therebelow so that a user's feet rested on said support surfaces are subject to movement, said movement being at least one of vertical movement and horizontal movement and rocking movement.

4. A system for exercising lower extremities of a seated person, comprising:

a motorized base having a housing;

two vertical axles extending from said housing;

two transverse arms pivotally mounted on respective ones of said two vertical axles;

support surfaces having lower surfaces pivotally mounted on free ends of said two transverse arms by hinge pivots so that said two transverse arms together with said support surfaces form a deformable parallelogram;

a connecting rod connected to one of said two transverse arms at a position offset from a corresponding one of said two vertical axles, said motorized base connected to drive said connecting rod so that a user's feet rested on said support surfaces are subject to movement, said movement being at least one of vertical movement and horizontal movement and rocking movement.

* * * * *